US005860754A

United States Patent [19]

Garland et al.

[11] Patent Number: 5,860,754

[45] Date of Patent: Jan. 19, 1999

[54] MOUTH-HELD MANIPULATING AND WRITING APPARATUS FOR PARALYTICS

[75] Inventors: Russell D. Garland, Royal Oak; Regis A. Gully, Dryden, both of Mich.

[73] Assignee: T.C.R. Industries, Royal Oak, Mich.

[21] Appl. No.: 753,955

[22] Filed: Dec. 3, 1996

[51] Int. Cl.[6] ..... B43K 23/00

[52] U.S. Cl. ..... 401/6; 401/93; 401/95

[58] Field of Search ..... 401/6, 93, 95

[56] References Cited

U.S. PATENT DOCUMENTS

| | | | |
|---|---|---|---|
| 130,216 | 8/1872 | Goodale . | |
| 376,137 | 1/1888 | Butler . | |
| 753,141 | 2/1904 | Kerr . | |
| 1,704,772 | 3/1929 | Spikins | 401/95 X |
| 2,012,317 | 11/1935 | McFarland et al. . | |
| 2,365,880 | 12/1944 | Juelss | 401/93 |
| 2,570,496 | 10/1951 | Seibert | 401/93 |
| 2,956,823 | 10/1960 | Benjamin et al. . | |
| 3,440,861 | 4/1969 | Oehlerking . | |
| 3,653,775 | 4/1972 | Ross . | |
| 3,795,281 | 3/1974 | Cloran . | |
| 3,824,022 | 7/1974 | Mancino . | |
| 4,585,363 | 4/1986 | McGuire | 401/6 |
| 4,728,812 | 3/1988 | Sheriff et al. . | |
| 4,822,035 | 4/1989 | Jennings et al. . | |
| 4,828,418 | 5/1989 | Sauer et al. . | |
| 4,944,711 | 7/1990 | Hironaka et al. . | |
| 5,485,357 | 1/1996 | Zolninger . | |

OTHER PUBLICATIONS

The American Journal of Occupational Therapy, "The Acrylic Mouthpiece", Robert R. Buckley, Anita H. Slominski, Jan.–Feb. 1958, vol. XII, No. 1, pp. 23–25.

Part Nos. H73217–0000 and H73217–0001, p. 28, Homecare Ableware Catalog # 1294 by Maddak Inc., Copyright 1995. Mouth–Held Page Turner.

*Primary Examiner*—Steven A. Bratlie

*Attorney, Agent, or Firm*—Harness, Dickey & Pierce, P.L.C.

[57] ABSTRACT

A telescopic, mouth-held manipulating and writing apparatus for paralytics consists of a replaceable mouthpiece, a fixed arm and an elongated extendable arm that interchangeably receives either a manipulating instrument or a writing instrument. An adjustment nut for extending or retracting the telescopic extension arm from the fixed arm is incorporated in the apparatus. A locking nut is incorporated on the extension arm of the apparatus for securing and releasing the manipulator or writing instrument. The adjustment nut, locking nut and extension arm are metallic, thereby promoting sterilization at high temperatures.

26 Claims, 3 Drawing Sheets

MOUTH-HELD MANIPULATING AND WRITING APPARATUS FOR PARALYTICS

BACKGROUND OF THE INVENTION

The present invention relates generally to a manipulating and writing apparatus and specifically to a manipulating and writing apparatus held in the mouth and useful to physically challenged individuals with limited or no use of their hands and arms. The apparatus of this invention is designed to give paralytics and other physically challenged individuals the freedom to write, paint, read, type, turn lights on and off, use the television or stereo and manipulate other normal everyday activities.

The use of mouth-held devices, designed to assist the physically challenged in the manipulation of tasks typically done by the hands, is known in the art. More specifically, prior devices of this type basically consist of wooden or plastic sticks held directly by the user's teeth, as well as sticks integrally connected to mouthpieces held within the user's mouth. Similar devices may be found within the December 1958 issue of The American Journal of Occupational Therapy (pages 23–25) and The Maddak, Inc (Ableware®) Catalog 1294, 1995 (page 28).

Traditionally, mouthpieces individually fit the user's tooth pattern for devices which incorporate mouthpieces. This mouthpiece, formed with indentations on its surface to accommodate the user's teeth, has often caused dental problems such as lockjaw and loosened teeth. An additional disadvantage of the traditional mouthpiece is that once the mouthpiece is worn, the entire device has to be discarded since the traditional mouthpiece is not detachable from the stick portion of the device. This inability to detach the worn mouthpiece from the remaining parts of the otherwise good conditioned device results in increased replacement costs.

Further, prior mouth-held devices incorporate various, familiar rubber-tipped ends for manipulating tasks like typing, turning on/off the electrical switch and other similar activities. Most prior devices of this type do not utilize an interchangeable end, whereby one end can be inserted for manipulating hand-related tasks or the other end can be inserted for writing and drawing.

Finally, another conventional device employs a motor for telescopically extending non-fixed length sticks to adapt to different tasks. Typically, these motorized, telescopic sticks include a motor, batteries, a battery chamber and contacts engaging the batteries. Not only is the cost of the device increased due to this multiplicity of components, but the maintenance and replacement costs are also increased because disassembly for cleaning and sterilization are virtually impossible. This device is also very heavy and can cause severe jaw fatigue.

Examples of traditional paralytic devices, incorporating one or more of the above characteristics, are disclosed with the following U.S. Pat. Nos. 4,828,418 entitled "Mouth-Held Device" which issued to Sauer et al. on May 9, 1989; 3,795,281 entitled "Telescopic Stick for Paralytics" which issued to Cloran on Mar. 5, 1974; and 3,653,775 entitled "Instruments to Supplement and Take the Place of Hands" which issued to Ross on Apr. 4, 1972. All of these patents are incorporated by reference herein.

SUMMARY OF THE INVENTION

In accordance with the present invention, the preferred embodiment of a manipulating and writing apparatus employs a replaceable mouthpiece, a fixed arm, an adjustable and telescoping extension arm and an optionally interchangeable writing and manipulating instrument. In another aspect of the present invention, the extension arm engagingly receives the writing or manipulating instrument, which is secured by the use of a locking nut. In a further aspect of the present invention, the extension arm moves inwardly along the axial centerline of the fixed arm and connects to the fixed arm through the use of an adjustment nut. In yet another aspect of the present invention, a mouthpiece mates with the fixed arm and is positioned for use between the user's upper and lower sets of teeth. A device for preventing saliva from entering the extension arm is also provided.

The manipulating and writing apparatus of the present invention is advantageous over conventional structures since the present invention does not employ indentations in the surface of the mouthpiece, thereby preventing the conventional dental problems such as lockjaw and loosened teeth. Additionally, the smooth, flat surfaced mouthpiece is replaceable when the mouthpiece becomes worn, without having to replace the entire apparatus; this encourages proper sterilization while reducing cost. Furthermore, the use of a locking nut and an adjustment nut allows the apparatus to be disassembled for cleaning. Moreover, the locking nut, adjustment nut and extension arm are made of titanium for allowing sterilization of the apparatus at high temperatures.

Additional advantages and features of the present invention will become apparent from the following description and appended claims, taken in conjunction with the accompanying drawings.

DETAILED DESCRIPTION OF THE PREFERRED EMBODIMENTS

Figure 1:
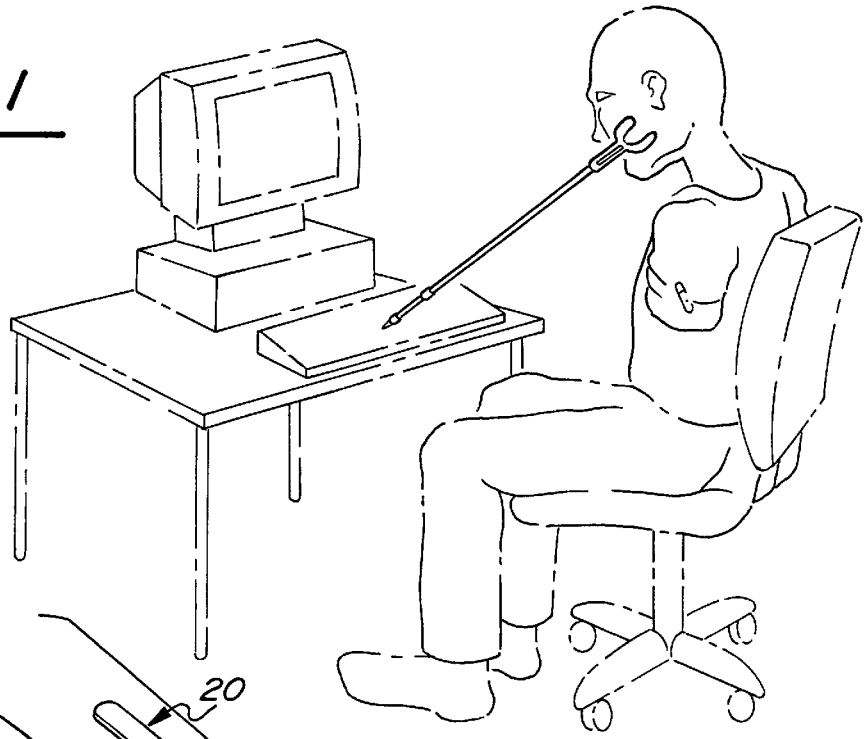
FIG. 1 is a perspective view of a first preferred embodiment of the manipulating and writing apparatus of the present invention, in use.

Manipulating tools and devices by hand is often an impossible task for paralytics and other physically challenged individuals without the use of a mouth-held apparatus. When the apparatus is retained in the mouth, the paralytic is able to manipulate tasks that would otherwise require the use of hands. FIG. 1 shows the use of such an apparatus by a paralytic in the manipulation of a computer keyboard.

Figure 2:
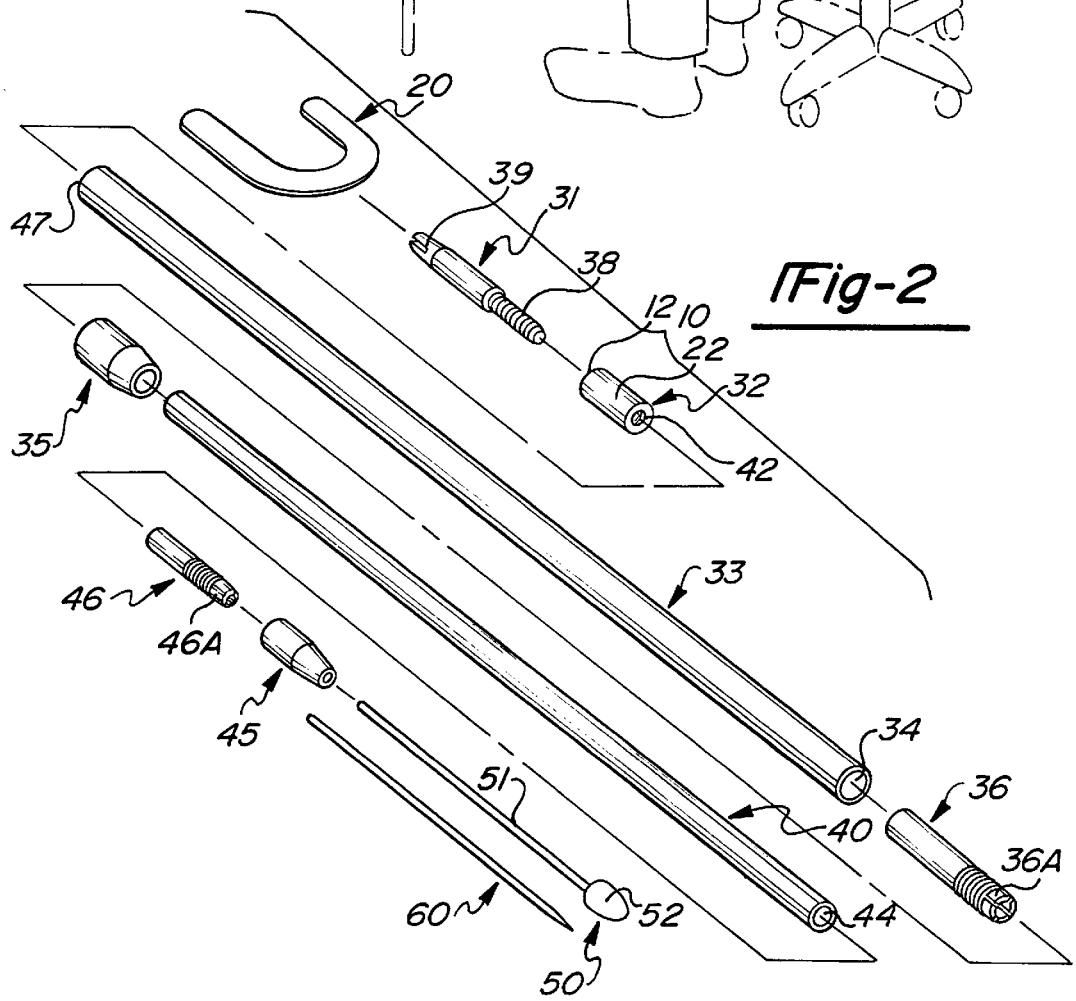
FIG. 2 is an exploded perspective view showing the first and second preferred embodiments of the manipulating and writing apparatus of the present invention.
Figure 3:
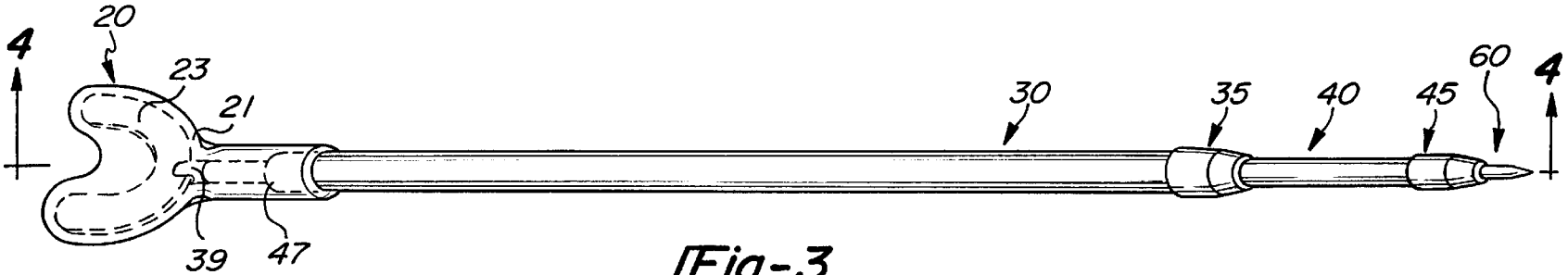
FIG. 3 is an assembled perspective view showing the second preferred embodiment of the manipulating and writing apparatus of the present invention.

As best illustrated in FIGS. 2 and 3, a first and second preferred embodiment of the manipulating and writing apparatus 10 of the present invention has a mouthpiece 20, a fixed arm 30 and an extension arm 40. In the first preferred embodiment, a manipulating instrument 50 is mounted to extension arm 40. In the second preferred embodiment, a writing instrument 60 is interchangeably mounted to extension arm 40 in place of manipulating instrument 50. Manipulating instrument 50 has an elongated rod 51 and a generally rounded, rubber tip 52. Rod 51 is extruded or machined from a cylindrical piece of titanium. Writing instrument 60 includes a Cross® pen filler insert, or any equivalent pen, pencil, marker or crayon insert.

Mouthpiece 20 is a generally flat and U-shaped member that is removably connected to a primary segment 33 of fixed arm 30 through a mouthpiece attachment segment 31 and an intermediate segment 32 of fixed arm 30. Mouthpiece 20 is welded or pressure fit (by heating) into a slotted portion 39 of mouthpiece attachment segment 31. An externally threaded portion 38 of mouthpiece attachment segment 31 engages with a threaded internal surface 42 of intermediate segment 32 for assembly. A non-threaded external surface 22 of intermediate segment 32 is pressure fit into a connecting end 47 of primary segment 33 such that an end surface 12 of intermediate segment 31 is flush with an end of connecting end 47.

Figure 4:
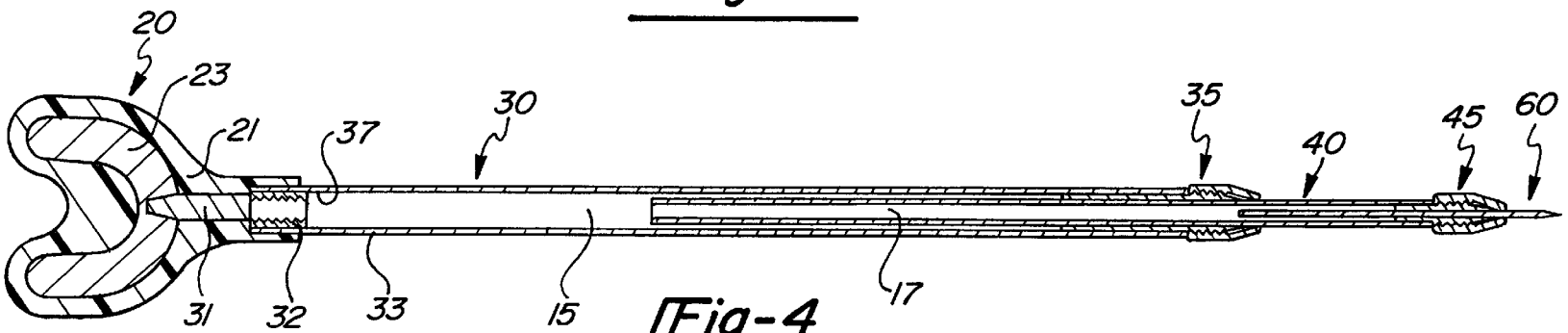
FIG. 4 is a longitudinal cross-sectional view, taken along line 4—4 of FIG. 3, showing the second preferred embodiment of the manipulating and writing apparatus of the present invention.

Referring now to FIGS. 2–4, primary segment 33 has a non-threaded internal surface 37 on connecting end 47 and an adjustment nut 35 threadably mounted on a receiving end 34. Receiving end 34 of primary segment 33 adjustably receives extension arm 40 in a coaxial manner. Extension arm 40 has a receiving end 44 that interchangeably receives manipulating instrument 50 or writing instrument 60. Extension arm 40 also has a locking nut 45 on receiving end 44 that interchangeably secures and releases manipulating instrument 50 and writing instrument 60. Both fixed arm 30 and extension arm 40 are externally cylindrical members machined from titanium. Further, both fixed arm 30 and extension arm 40 are substantially hollow.

Figure 5:
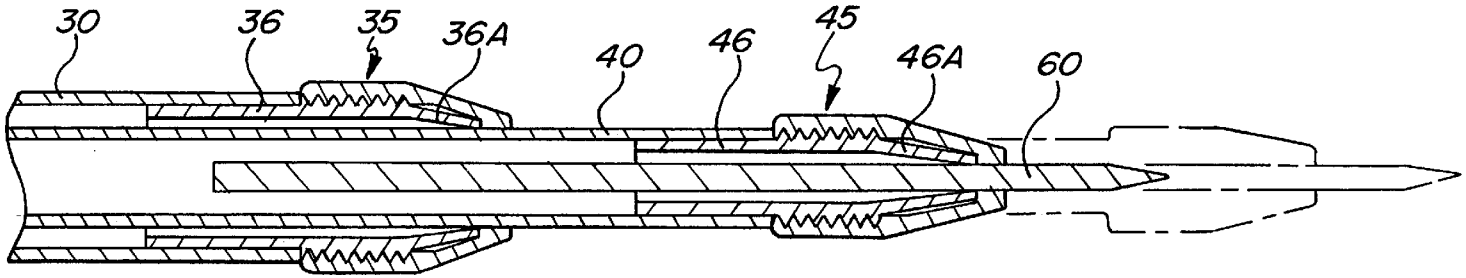
FIG. 5 is an enlarged, fragmentary, cross-sectional view, also taken along line 4—4 of FIG. 3, showing the second preferred embodiment of the manipulating and writing apparatus of the present invention in a mostly retracted position of extension arm movement.
Figure 6:
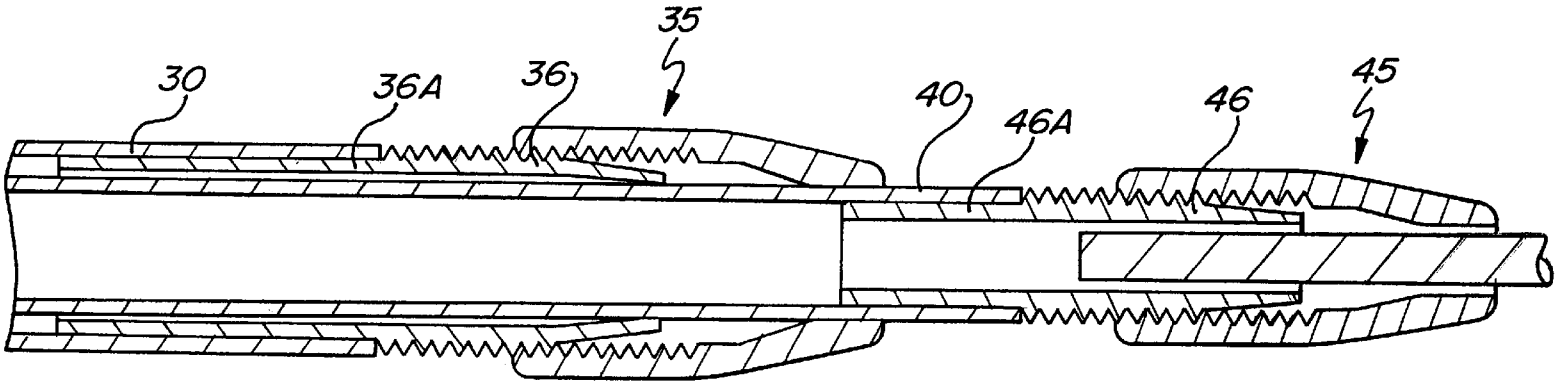
FIG. 6 is an enlarged, fragmentary, cross-sectional view, similar to that of FIG. 5, showing an adjustment nut and locking nut of both preferred embodiments of the manipulating and writing apparatus, in an unlocked position.
Figure 7:
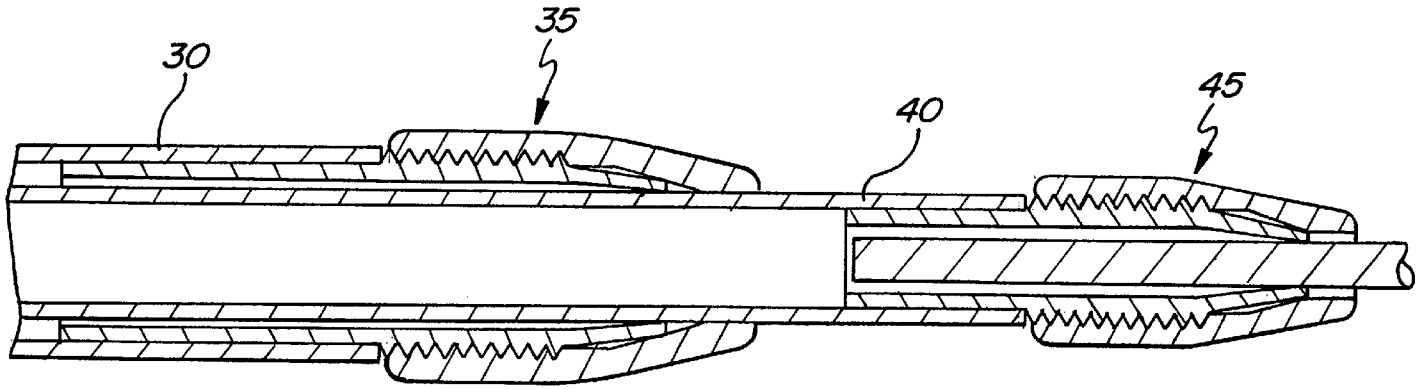
FIG. 7 is an enlarged, fragmentary, cross-sectional view, similar to that of FIG. 5, showing an adjustment nut and locking nut of both preferred embodiments of the manipulating and writing apparatus, in a locked position.

As best illustrated in FIGS. 5–7, adjustment nut 35 is used to adjust the length of extension arm 40 relative to fixed arm 30 along the axial centerline of the two parts for infinite telescoping length adjustment. Adjustment nut 35 is an internally threaded member with one frusto-conical tapered end. Adjustment nut 35 is threadably connected to primary segment 33 of fixed arm 30 at receiving end 34. Adjustment nut 35 has an internal clip 36 with fingers 36*a* that secure and release extension arm 40, for telescopically lengthening and shortening extension arm 40 relative to fixed arm 30, by compressing and releasing fingers 36*a* towards and away from an opening 15 in fixed arm 30. Likewise, locking nut 45 an internally threaded member with one frusto-conical tapered end. Locking nut 45 is used to secure and release interchangeable manipulating instrument 50 and writing instrument 60. Locking nut 45 is threadably connected to extension arm 40 at receiving end 44. Locking nut 45 also has an internal clip 46 with fingers 46*a*. Internal clip 46 of locking nut 45 secure and release manipulating instrument 50 and writing instrument 60, so that the user can interchangeably use either as desired, by compressing and releasing fingers 46*a* towards and away from an opening 17 in extension arm 40. Both sets of fingers 36*a* and 46*a* of internal clips 36 and 46, respectively, have tapered ends that align with the frusto-conical tapered ends of adjustment nut 35 and locking nut 45, respectively. Additionally, the use of adjustment nut 35 and locking nut 45 allow the apparatus to be disassembled for cleaning. Because fixed arm 30, extension arm 40, adjustment nut 35 and locking nut 45 are made of titanium, when the coated mouthpiece is removed, sterilization of the apparatus at high temperatures is possible, as required for U.S. Medicaid and Medicare approval.

FIG. 2 shows a U-shaped, titanium base 23 of mouthpiece 20, and mouthpiece attachment segment 31, without any coating. Referring now to FIG. 3, a plastic polyol coating 21, covering base 23, mouthpiece attachment segment 31 and connecting end 47 of primary segment 33, externally seals mouthpiece 20 and connecting end 47 and prevents saliva from entering fixed arm 30 and extension arm 40. When coated, mouthpiece 20 has a generally heart shaped, flat surface with no teeth indentations. Additionally, mouthpiece 20 is replaceable when plastic coating 21 becomes worn. Mouthpiece 20, along with connected mouthpiece attachment segment 31, intermediate segment 32 and plastic coating 21, is detached from connecting end 47 of primary segment 33 and replaced with a new mouthpiece attachment. It is envisioned that only the mouthpiece will be sent back to the manufacturer for replacement.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. An apparatus for manipulating or writing, said apparatus comprising:

a mouthpiece having a metallic base and a plastic covering;

a rigid attachment segment connecting to said base;

a first arm removably connected to said attachment segment; and a second arm adapted for engagingly receiving an instrument, said second arm being coaxially secured to said first arm and being movable relative to said first arm.

2. The apparatus of claim 1 wherein said first arm includes:

a primary segment; and an intermediate segment internally engaging said primary segment, said intermediate segment having a threaded internal surface.

3. The apparatus of claim 2 wherein said primary segment is defined as an elongated, externally cylindrical rod.

4. The apparatus of claim 2 wherein said primary segment includes an adjustment nut at a receiving end for telescopically modifying the length of said second arm relative to said first arm, said adjustment nut having a frusto-conical tapered end.

5. The apparatus of claim 4 wherein said primary segment further includes a substantially hollow interior for engagingly receiving said second arm.

6. The apparatus of claim 4 wherein said adjustment nut is threadably connected to said receiving end of said primary segment.

7. The apparatus of claim 5 wherein said opening includes a clip at said receiving end of said primary segment, said clip having a plurality of fingers for securingly engaging said second arm.

8. The apparatus of claim 2 wherein said attachment segment includes:

a threaded portion for threadably engaging with said threaded internal surface of said intermediate segment; and a slotted portion having a slot for connecting with said mouthpiece.

9. The apparatus of claim 1 wherein said second arm is defined as an elongated, externally cylindrical rod extending telescopically outward from said first arm in infinitely adjustable increments.

10. The apparatus of claim 1 wherein said second arm includes a locking nut at a receiving end for allowing the securing and releasing of said instrument.

11. The apparatus of claim 10 wherein said second arm further includes a substantially hollow interior for engagingly receiving said instrument.

12. The apparatus of claim 10 wherein said locking nut is threadably connected to said receiving end of said second arm.

13. The apparatus of claim 11 wherein said interior includes a clip at said receiving end of said second arm, said clip having a plurality of fingers for securingly engaging said instrument.

14. The apparatus of claim 1 wherein said mouthpiece has substantially flat upper and lower surfaces.

15. The apparatus of claim 1 wherein said mouthpiece and said attachment segment are externally sealed together by said plastic covering for deterring saliva from entering said first arm.

16. A mouth-held apparatus for manipulating or writing, said apparatus comprising:

a removable writing instrument;

a removable manipulating instrument defined as an elongated cylindrical rod having a larger tip axially protruding from an exposed end of said rod;

an extension arm interchangeably and engagingly receiving one of said instruments;

a fixed arm, said extension arm telescopically adjustable and coaxially movable relative to said fixed arm;

a rigid mouthpiece receiving segment connected to said fixed arm; and a replaceable mouthpiece removably joined to said fixed arm and having a substantially flat surface.

17. The mouth-held apparatus of claim 16 wherein said mouthpiece includes a metal base and a plastic covering, whereby said mouthpiece is replaceable when said plastic covering becomes worn.

18. The mouth-held apparatus of claim 16 wherein said fixed arm includes a first nut for telescopically adjusting the length of said extension arm relative to said fixed arm, said first nut having a frusto-conical tapered end.

19. The mouth-held apparatus of claim 18 wherein said first nut is threadably connected to a receiving end of said fixed arm.

20. The mouth-held apparatus of claim 16 wherein said extension arm includes a second nut for interchangeably securing and releasing one of said instruments, said second nut having a frusto-conical tapered end.

21. The mouth-held apparatus of claim 20 wherein said second nut is threadably connected to a receiving end of said extension arm.

22. A mouth-held apparatus for manipulating and writing, said apparatus comprising:

a writing instrument;

an elongated, cylindrical manipulating instrument having a larger tip axially protruding from an exposed end of said instrument;

an elongated, externally cylindrical extension arm extending telescopically outward from a fixed arm in infinitely adjustable increments, said extension arm including a hollow interior and a receiving end for interchangeably and engagingly receiving one of said instruments;

a mouthpiece having substantially flat upper and lower surfaces, said mouthpiece having a metal base and being plastic coated, whereby said mouthpiece is replaceable when said plastic coating becomes worn;

a fixed arm including:

(a) an elongated, externally cylindrical primary segment, said primary segment being externally sealed for substantially preventing saliva from entering said fixed arm;

(b) an intermediate segment internally engaging said primary segment, said intermediate segment having a threaded internal surface; and (c) a mouthpiece attachment segment;

said primary segment including a hollow interior and a receiving end for receiving said extension arm;

said mouthpiece attachment segment including:

(a) a threaded portion for threadably engaging with said threaded internal surface of said intermediate segment; and (b) a slotted portion for connecting with said mouthpiece;

said mouthpiece being removable from said intermediate segment and replaceable;

said mouthpiece coupling with said fixed arm thereby positionably controlling said arms;

a locking device allowing the securing and releasing of said instrument, a threadably removable locking nut of said locking device having a frusto-conical tapered end and a clip with a plurality of fingers securely engaging said receiving end of said extension arm with said instrument, said locking nut threadably engaging with said receiving end of said extension arm; and an adjustment device allowing telescopic sliding of said extension arm relative to said fixed arm, a threadably removable adjustment nut of said adjustment device having a frusto-conical tapered end and a clip with a plurality of fingers securely engaging said receiving end of said fixed arm with said extension arm, said adjustment nut threadably engaging with said receiving end of said fixed arm.

23. The mouth-held apparatus of claim 22 being disassemblable for cleaning, said arms and nuts being made from titanium for sterilizing at high temperatures.

24. A mouth-held apparatus disassemblable for cleaning, said apparatus comprising:

a first arm being cylindrically elongated;

a mouthpiece externally sealed for deterring saliva from entering said first arm;

said first arm having a first locking member and being removably matable to said mouthpiece;

a cylindrically elongated second arm telescopically extendable and coaxially movable relative to said first arm in infinitely adjustable increments by manual unlocking of said first locking member, said second arm having a second locking member;

said arms being made from a metallic material including titanium suitable to withstand sterilization temperatures; and a writing instrument removable from said second arm by manual unlocking of said second locking member.

25. The mouth-held apparatus of claim 24 wherein said first locking member includes a set of fingers compressibly engaging said second arm for locking said second arm to said first arm.

26. The mouth-held apparatus of claim 24 wherein said second locking member includes a set of fingers compressibly engaging said writing instrument for locking said writing instrument to said second arm.

* * * * *

UNITED STATES PATENT AND TRADEMARK OFFICE

CERTIFICATE OF CORRECTION

PATENT NO. : 5,860,754

DATED : January 19, 1999

INVENTOR(S) : Russell D. Garland and Regis A. Gully

It is certified that error appears in the above-identified patent and that said Letters Patent is hereby corrected as shown below:

On Title Page under References Cited U.S. Patent Documents Patent No. is 2,012,317 should be 2,021,317

Signed and Sealed this

Twenty-fifth Day of May, 1999

*Attest:*

Q. TODD DICKINSON

*Attesting Officer*

*Acting Commissioner of Patents and Trademarks*